US008148920B2

(12) United States Patent
Lee et al.

(10) Patent No.: US 8,148,920 B2
(45) Date of Patent: Apr. 3, 2012

(54) METHOD OF CONTROLLING A BALLAST FOR A HIGH INTENSITY DISCHARGE LAMP AND RELATED SYSTEM

(75) Inventors: Li-Ling Lee, Hsinchu (TW); Ching-Ran Lee, Hsinchu (TW); Jia-Hong Chen, Hsinchu (TW); Chin-Sien Moo, Hsinchu (TW); Sheng-Yi Tang, Hsinchu (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 310 days.

(21) Appl. No.: 12/469,870

(22) Filed: May 21, 2009

(65) Prior Publication Data

US 2010/0060201 A1 Mar. 11, 2010

(30) Foreign Application Priority Data

Sep. 8, 2008 (TW) ..... 97134348 A

(51) Int. Cl.
*H05B 41/36* (2006.01)

(52) U.S. Cl. ..... 315/308; 315/200 R; 315/209 R; 315/247; 315/291; 315/360

(58) Field of Classification Search ..... 315/200 R, 315/209 R, 247, 291, 307–308, 360
See application file for complete search history.

(56) References Cited

U.S. PATENT DOCUMENTS

| | | | | |
|---|---|---|---|---|
| 4,928,038 | A * | 5/1990 | Nerone | 315/209 R |
| 5,381,077 | A * | 1/1995 | McGuire | 315/247 |
| 6,914,395 | B2 * | 7/2005 | Yamauchi et al. | 315/308 |
| 6,958,581 | B2 * | 10/2005 | Okawa et al. | 315/291 |
| 7,425,802 | B2 * | 9/2008 | Kumagai et al. | 315/291 |
| 2004/0183473 | A1 * | 9/2004 | Kamoi et al. | 315/291 |

FOREIGN PATENT DOCUMENTS

| | | |
|---|---|---|
| JP | 2003-229289 A | 8/2003 |
| JP | 2007-514288 A | 5/2007 |

* cited by examiner

*Primary Examiner* — Jason M Crawford
(74) *Attorney, Agent, or Firm* — Rabin & Berdo, P.C.

(57) ABSTRACT

A method of controlling a ballast for a high intensity discharge (HID) lamp and related system. The method includes setting initial operating parameters of the ballast to turn on the HID lamp, generating starting transient electric characteristic values of the HID lamp by measuring actual electric parameters at a predetermined time during a transient process after the HID lamp is turned on, searching stored data for a rated power corresponding to the starting transient electric characteristic value range of the HID lamp after determining that the starting transient electric characteristic value is within stored starting transient electric characteristic value ranges of the HID lamp, and searching the stored data for a corresponding ballast operating parameter, to allow the HID lamp to operate in the corresponding rated power, and realize that a single ballast can be adapted to and control the HID lamps to operable in their respective specific rated power.

18 Claims, 8 Drawing Sheets

| rated power | electric parameter difference range | operating parameter (duty-ratio) |
|---|---|---|
| 20w | (i(5)-i(15))>1.5A | a% |
| 35w | (i(5)-i(15))<1.5A and (i(5)-i(35))>1.5A | b% |
| 70w | (i(5)-i(15))<1.5A and (i(5)-i(35))<1.5A | c% |

FIG. 4

| rated power | electric parameter difference range | operating parameter (duty-ratio) |
|---|---|---|
| 20w | (v(30)-v(6))>30V | a% |
| 35w | (v(30)-v(6))<30V and (v(40)-v(6))>15V | b% |
| 70w | (v(30)-v6))<30V and (v(40)-v(6))<15V | c% |

FIG. 5

METHOD OF CONTROLLING A BALLAST FOR A HIGH INTENSITY DISCHARGE LAMP AND RELATED SYSTEM

BACKGROUND OF THE INVENTION

1. Field of the Invention

This invention relates to a method of controlling a ballast for a high intensity discharge (HID) lamp, and more particularly, to a method of controlling a ballast to enable the HID lamp to operate in its dedicated rated power and a related system.

2. Description of Related Art

A high intensity discharge (HID) lamp, such as a metal halide lamp, high pressure sodium lamp and a mercury vapor lamp, employs a gas discharge principle to generate visible light. The HID lamp has the advantages of compact size, high light emitting efficiency and broad power range, e.g. from a few watts to ten of thousands of watts, and is becoming one of the most popular lighting devices in the market.

A HID lamp cannot operate without a ballast. However, an existing ballast is designed to be applied to a HID lamp operating in specific rated power, and the HID lamp has to operate with its own dedicated ballast in order to operate normally. Since there are many models of HID lamps in the market and these HID lamps have diverse rated power, a variety of standards of ballasts, each of which controls only one model of HID lamp, have to be brought to the market accordingly, which increases the cost for the manufacturers and dealers in manufacturing backup, scheduling and product stock. Further, in selecting a ballast that matches with the rated power of a HID lamp, it is easily to erroneously select a ballast that does not match with the HID lamp, since HID lamps, even operable in various rated power, use the same lamp stand. If the ballast is erroneously selected and does not match with the HID lamp, and since the existing ballast is designed to control the HID lamp by driving the current or power of the HID lamp, once the HID lamp is turned on and operates in a stable process, the HID lamp still has similar performance, regardless of the variation of the rated power. For example, a metal halide lamp of a low rates less than 150 watts, when operating in the stable process, has a HID lamp voltage within a range from 80 to 90 voltages. Even if under an over-power and modifying process, the metal halide lamp still has very little variation on the HID lamp voltage. Therefore, the ballast functions normally, and the HID lamp continues to operate in the power driven by the ballast, but the life span of the HID lamp is greatly affected. Therefore, after the HID lamp is driven by the current ballast to enter the stable process, no message is presented for identification to reselect a matched ballast.

Under the premise that the lamp stands have such a high compatibility, it is demanding for research a general ballast applicable to a HID lamp operable in various rated power, in order to reduce the cost, prevent from erroneous selection of the ballast, and increase the life span of the HID lamp.

SUMMARY OF THE INVENTION

In views of the above-mentioned problems of the prior art, it is a primary objective of the present invention to provide a method of controlling a ballast for a HID lamp and a related system, to identify the rated power of the HID lamp accurately and enable the HID lamp to operate in its dedicated rated power normally.

It is another objective of the present invention to provide a method of controlling a ballast for a HID lamp and a related system, to reduce the cost of the ballast.

It is a further objective of the present invention to provide a method of controlling a ballast for a HID lamp and a related system, to prevent the ballast from erroneously selecting a rated power, and increase the life span of the HID lamp.

To achieve the above-mentioned and other objectives, a method of controlling a ballast for a HID lamp is provided according to the present invention. The method includes steps of (a) outputting an initial operating parameter to the ballast to turn on the HID lamp, (b) measuring an actual electric parameter at least one predetermined time during a transient process after the HID lamp is turned on, and generating a starting transient electric characteristic value of the HID lamp, (c) determining whether the starting transient electric characteristic value is within a starting transient electric characteristic value range of the HID lamp, and searching stored rated power for a rated power corresponding to the HID lamp according to a corresponding associated relation between the starting transient electric characteristic value range of the HID lamp and the stored rated power if the starting transient electric characteristic value is within the starting transient electric characteristic value range of the HID lamp, and (d) searching the stored rated power for a corresponding ballast operating parameter according to a corresponding associated relation between the stored rated power and the ballast operating parameter, and outputting the corresponding ballast operating parameter to the ballast, to allow the HID lamp to operate in the corresponding rated power.

The initial operating parameter of the ballast and the ballast operating parameter can be set to be the frequency, phase, duty-ratio, and duty-time of the ballast, or a lamp current or lamp power for controlling an output of the ballast, but is not limited thereto.

The starting transient electric characteristic value of the HID lamp can be a lamp current, lamp voltage or lamp power, or an electric parameter calculated from the previous values, such as a lamp equivalent impedance. The number of the predetermined time depends on the function intensity of the system, and can be equal to one or more than one.

The starting transient electric characteristic value of the HID lamp is derived from actual electric parameters of the HID lamp. In a system having simple function requirement, one predetermined time suffices for the requirement, while in a demanding system, two or more than two predetermined time have to be selected as the time when the actual electric parameters are measured and obtained.

Step (c) includes determining whether an starting transient electric characteristic values is within one of stored starting transient electric characteristic value ranges of the stored data according to the starting transient electric characteristic value of the HID lamp and the starting transient electric characteristic value ranges. An indication message is provided after the starting transient electric characteristic value is determined not within the starting transient electric characteristic value ranges of the stored data.

To achieve the same objectives, a system for controlling a ballast for a HID lamp is provided according to the present invention. The system includes a setting module for outputting an initial operating parameter to the ballast to turn on the HID lamp; a measuring module for measuring an actual electric parameter at least one predetermined time during a transient process after the HID lamp is turned on; and a processing module for receiving the actual electric parameter measured by the measuring module and generating a starting transient electric characteristic value of the HID lamp, determining whether the starting transient electric characteristic value is within stored starting transient electric characteristic value ranges of the HID lamp, searching stored rated power for a rated power according to a corresponding associated relation between the stored starting transient electric characteristic value ranges of the HID lamp and the stored rated power, searching stored data for a corresponding ballast operating parameter according to a corresponding associated relation between the stored rated power and the ballast operating parameter, and outputting the corresponding ballast operation parameter to the ballast, to allow the HID lamp to operate in the corresponding rated power.

The system further includes a storage unit for storing a plurality of rated power of the HID lamp, a plurality of starting transient electric characteristic value ranges of the HID lamp corresponding to the plurality of rated power in a one-to-one manner, and a plurality of ballast operating parameters corresponding to the plurality of rated power in a one-to-one manner. The initial operating parameter of the ballast and the ballast operating parameter can be set to be the frequency, phase, duty-ratio, and duty-time of the ballast, or a lamp current or lamp power for controlling an output of the ballast, but is not limited thereto. The starting transient electric characteristic value of the HID lamp can be a lamp current, lamp voltage or lamp power, or an electric parameter calculated from the previous values, such as a lamp equivalent impedance. The number of the predetermined time depends on the function intensity of the system, and can be equal to one or more than one. The starting transient electric characteristic value of the HID lamp is derived from actual electric parameters of the HID lamp. In a system having simple function requirement, one predetermined time suffices for the requirement, while in a demanding system, two or more than two predetermined time have to be selected as the time when the actual electric parameters are measured and obtained.

In the system, the processing module includes a calculating unit for receiving the actual electric parameter measured by the measuring module and calculating the starting transient electric characteristic value of the HID lamp; a determining unit for receiving the starting transient electric characteristic value of the HID lamp calculated by the calculating unit, determining whether the starting transient electric characteristic value is within any one of the starting transient electric characteristic value ranges stored in the storage unit, and sending a searching signal if the starting transient electric characteristic value is within one of the starting transient electric characteristic value ranges stored in the storage unit, or else, sending an indication signal; an indicating unit for receiving the indication signal sent from the determining unit and providing an indication message; a searching unit for receiving the searching signal sent from the determining unit, searching the storage unit for a rated power complying with the starting transient electric characteristic value ranges, and searching the storage unit for a corresponding operating parameter according to a corresponding associated relation between the rated power and the ballast operating parameter; and an outputting unit for receiving the ballast operating parameter searched by the searching unit and outputting the ballast operating parameter to the ballast, to allow the HID lamp to operate normally.

The ballast includes a driving module electrically connected to the HID lamp for controlling the HID lamp to operate in a corresponding power or current. The driving module includes a power regulating unit for receiving the initial operating parameter output from the setting module or the ballast operating parameter output from the processing module, and generating a regulation signal according to the operating parameter; and a driving unit electrically connected to the power regulating unit and the HID lamp for receiving the regulation signal generated by the power regulating unit to control the HID lamp to operate in a corresponding power or current.

In summary, the method of controlling a ballast in a HID lamp and related system of the present invention employ a storage unit to store a plurality of rated power of the HID lamp, a plurality of starting transient electric characteristic value ranges of the HID lamp corresponding to the rated power, and a plurality of ballast operating parameters corresponding to the rated power, a setting module to set the operating parameters of the ballast and output the operating parameters to a driving module of the ballast to turn on the HID lamp, and a measuring module to measure, during a transient process after the HID lamp is turned on, a plurality of actual electric parameters of the HID lamp at various predetermined time, for a processing module to generate a starting transient electric characteristic value of the HID lamp, search the storage unit for a rated power corresponding to the starting transient electric characteristic value range of the HID lamp after determining that the starting transient electric characteristic value is within any one of the starting transient electric characteristic value ranges stored in the storage unit, and search the storage unit for a corresponding ballast operating parameter according to a corresponding associated relation between the rated power and the ballast operating parameter and output the ballast operating parameter to the driving module, to allow the HID lamp to operate in the corresponding rated power.

Therefore, the ballast can be adapted to and control the HID lamps to operable in their respective specific rated power, such that the drawbacks of the prior art, such as that since there are a variety of models of HID lamps and these HID lamps have diverse rated power a variety of ballasts have to be brought to the market, which increases the cost for the manufacturer to manufacture the ballast, can be overcome. Further, there is no need for the method and system of the present invention to consider the rated power of the HID lamp, and the problem that the HID lamp selects an inappropriate ballast is solved.

BRIEF DESCRIPTION OF DRAWINGS

The invention can be more fully understood by reading the following detailed description of the preferred embodiments, with reference made to the accompanying drawings, wherein:

FIG. 1, including

FIG. 4 is a table illustrating a plurality of rated power and current parameter difference ranges stored in a storage unit of a system for controlling a ballast for a HID lamp and ballast operating parameters; and FIG. 5 is a table illustrating a plurality of rated power and voltage parameter difference ranges stored in a storage unit of a system for controlling a ballast for a HID lamp and ballast operating parameters.

DETAILED DESCRIPTION OF PREFERRED EMBODIMENTS

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

Figure 1A:
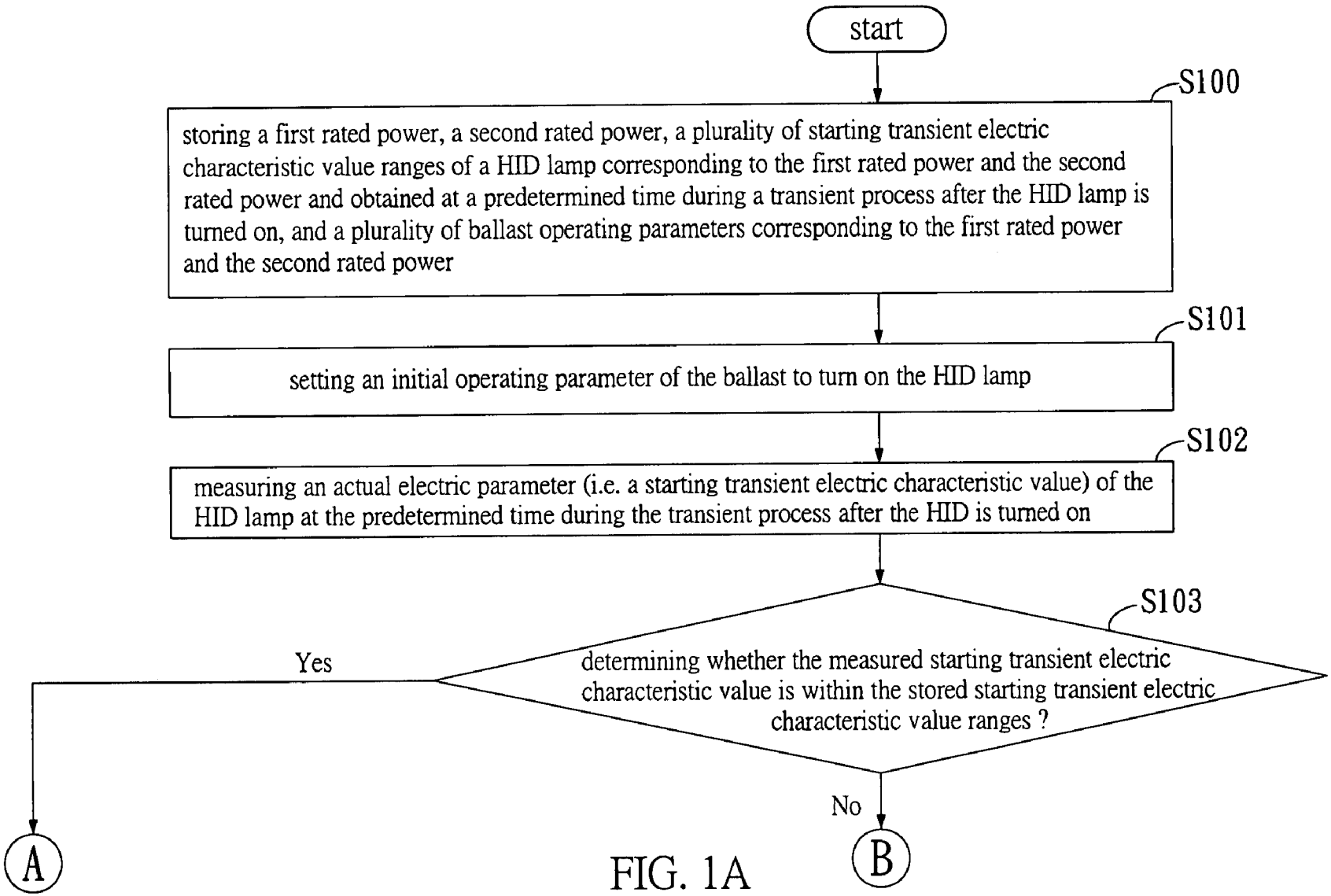
FIGS. 1A and 1B, is a flow chart of a method of controlling a ballast for a HID lamp of an embodiment according to the present invention.
Figure 1B:
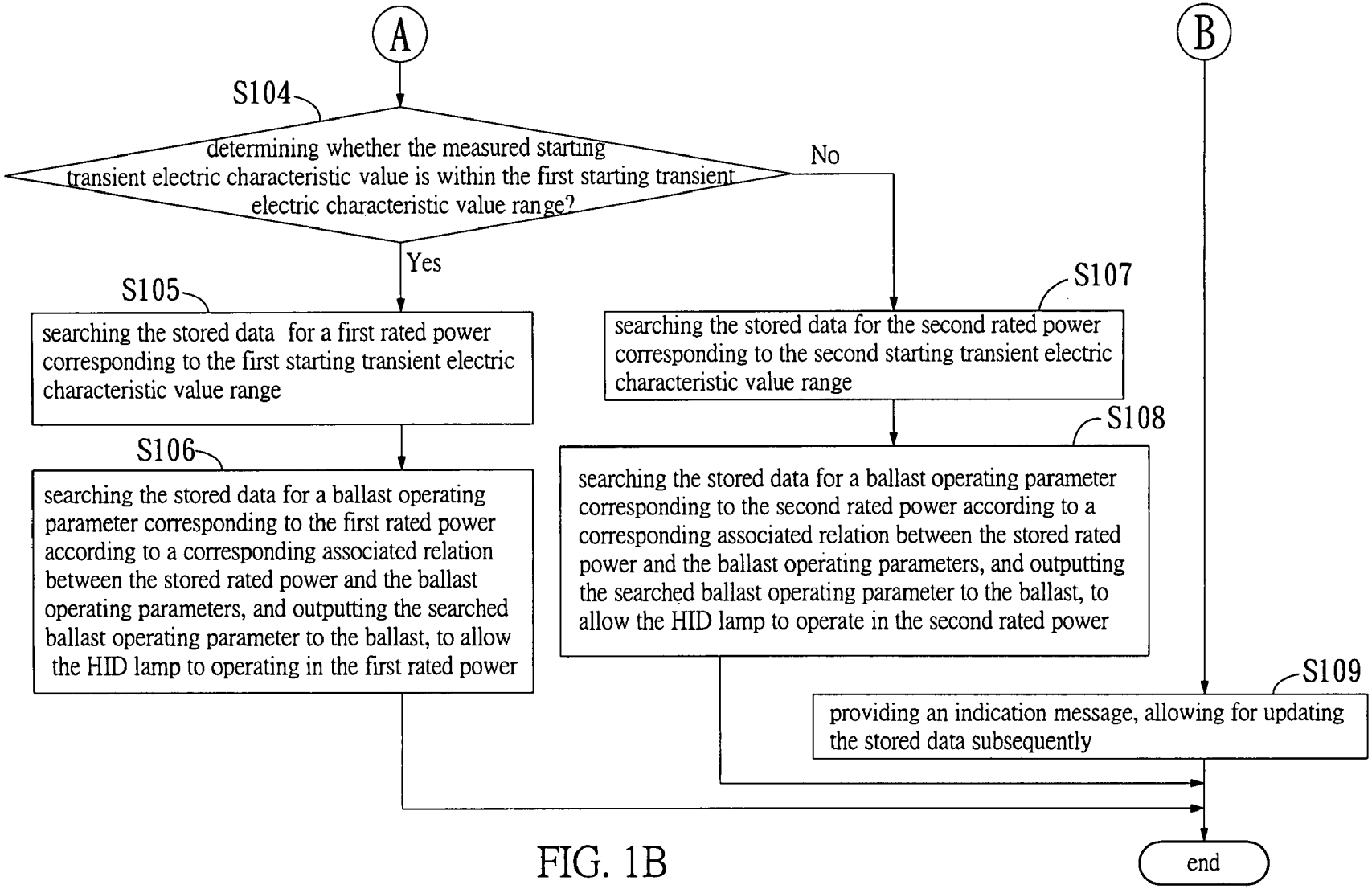

Please refer to FIG. 1, including FIGS. 1A and 1B, which is a flow chart of a method of controlling a ballast for a HID lamp of an embodiment according to the present invention. The method of the present invention controls at least two HID lamps having their own specific rated power to operate in their own specific rated power, which are exemplified as a first rated power and a second rated power in the embodiment.

The method starts in step S100. In step S100, the method discloses storing the first rated power, the second rated power, a plurality of starting transient electric characteristic value ranges corresponding to the first rated power and the second rated power in a one-to-one manner, and a plurality of ballast operating parameters corresponding to the first rated power and the second rated power in a one-to-one manner, wherein the starting transient electric characteristic value ranges comprise a first starting transient electric characteristic value range and a second starting transient electric characteristic value range corresponding to the first rated power and second rated power, respectively, and are obtained at predetermined time during a transient process after the HID lamp is turned on by measuring electric parameters presented by the HID lamp through experiments on measuring and comparing actual electric parameters, the electric parameters comprising voltage parameters, current parameters, and power parameters. Since a power parameter of the HID lamp is equal to a voltage parameter multiplied by a current parameter, and the variations in the power parameter can be reflected by the variations in the voltage and current parameter completely, only the voltage parameter and the current parameter are used to describe the present invention in the following embodiments. Further, the ballast operating parameters comprise a duty-ratio, duty-time, frequency and phase of the ballast, and those used to control the lamp current or lamp power output by the ballast. In the following embodiments, the ballast operating parameters are the duty-ratio of the ballast. In order to clearly understand the method of the present invention, the first rated power is equal to 20 watts, the second rated power is equal to 35 watts, the starting transient electric characteristic value range is the current parameter, the predetermined time is 15 seconds, the first transient electric characteristic value range is less than 1.5 amps and corresponds to the first rated power of 20 watts, and the second starting transient electric characteristic value range is greater than 1.5 amps and corresponds to the second rated power of 35 watts. The method proceeds to step S101.

In step S101, the method discloses setting an initial operating parameter of the ballast to turn on the HID lamp. In this embodiment, the initial operating parameter is the duty-ratio of the ballast. In another embodiment, the initial operating parameter can be the duty-time, frequency or phase of the ballast. In this embodiment, the initial operating parameter is set to cause the ballast to have an output power of 25 watts. The method proceeds to step S102.

In step S102, the method discloses measuring an actual electric parameter of the HID lamp at the predetermined time during the transient process after the HID is turned on, and generating a starting transient electric characteristic value of the HID lamp. In this embodiment, the actual electric parameter is an actual current parameter and is denoted by i(15). The method proceeds to step S103.

In step S103, the method discloses determining whether the measured starting transient electric characteristic value is within the stored starting transient electric characteristic value ranges, i.e. the first starting transient electric characteristic value range or the second starting transient electric characteristic value range. If the measured starting transient electric characteristic value is within the stored starting transient electric characteristic value ranges, the method proceeds to step S104, or else (that is, the measured starting transient electric characteristic value is neither within the first starting transient electric characteristic value range nor within the second starting transient electric characteristic value range), the method proceeds to step S109.

In step S104, the method discloses determining whether the measured starting transient electric characteristic value is within the first starting transient electric characteristic value range. If the measured starting transient electric characteristic value is within the first starting transient electric characteristic value range, the method proceeds to step S105, or else, indicating that the measured starting transient electric characteristic value is within the second starting transient electric characteristic value range, the method proceeds to step S107.

In step S105, the method discloses searching the stored data (in step S100) for a first rated power corresponding to the first starting transient electric characteristic value range. The rated power of the HID lamp is identified to be the first rated power. The method proceeds to step S106.

In step S106, the method discloses searching the stored data for a ballast operating parameter corresponding to the first rated power according to a corresponding associated relation between the stored rated power and the ballast operating parameters, and outputting the searched ballast operating parameter to the ballast, to allow the HID lamp to operating in the first rated power. The method ends.

In step S107, the method discloses searching the stored data for the second rated power corresponding to the second starting transient electric characteristic value range. The method proceeds to step S108.

In step S108, the method discloses searching the stored data for a ballast operating parameter corresponding to the second rated power according to a corresponding associated relation between the stored rated power and the ballast operating parameters, and outputting the searched ballast operating parameter to the ballast, to allow the HID lamp to operate in the second rated power. The method ends.

In step S109, the method discloses providing an indication message, such as sounds or indication light, to indicate that the current rated power of the HID lamp is not any one of the stored rated power, allowing for updating the stored data subsequently.

Figure 2A:
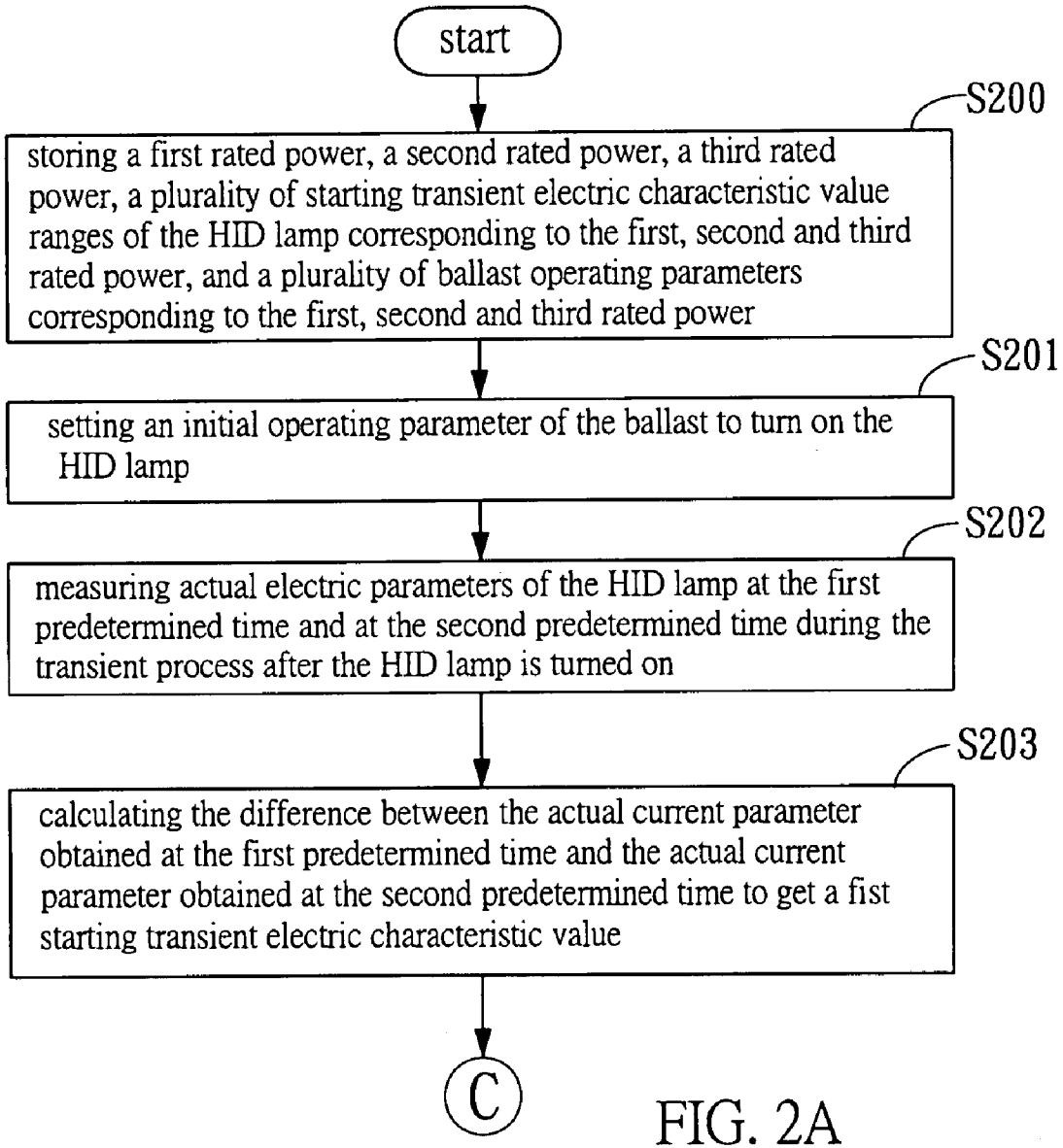
FIGS. 2A, 2B and 2C are flow charts of a method of controlling a ballast for a HID lamp of another embodiment according to the present invention.
Figure 2B:
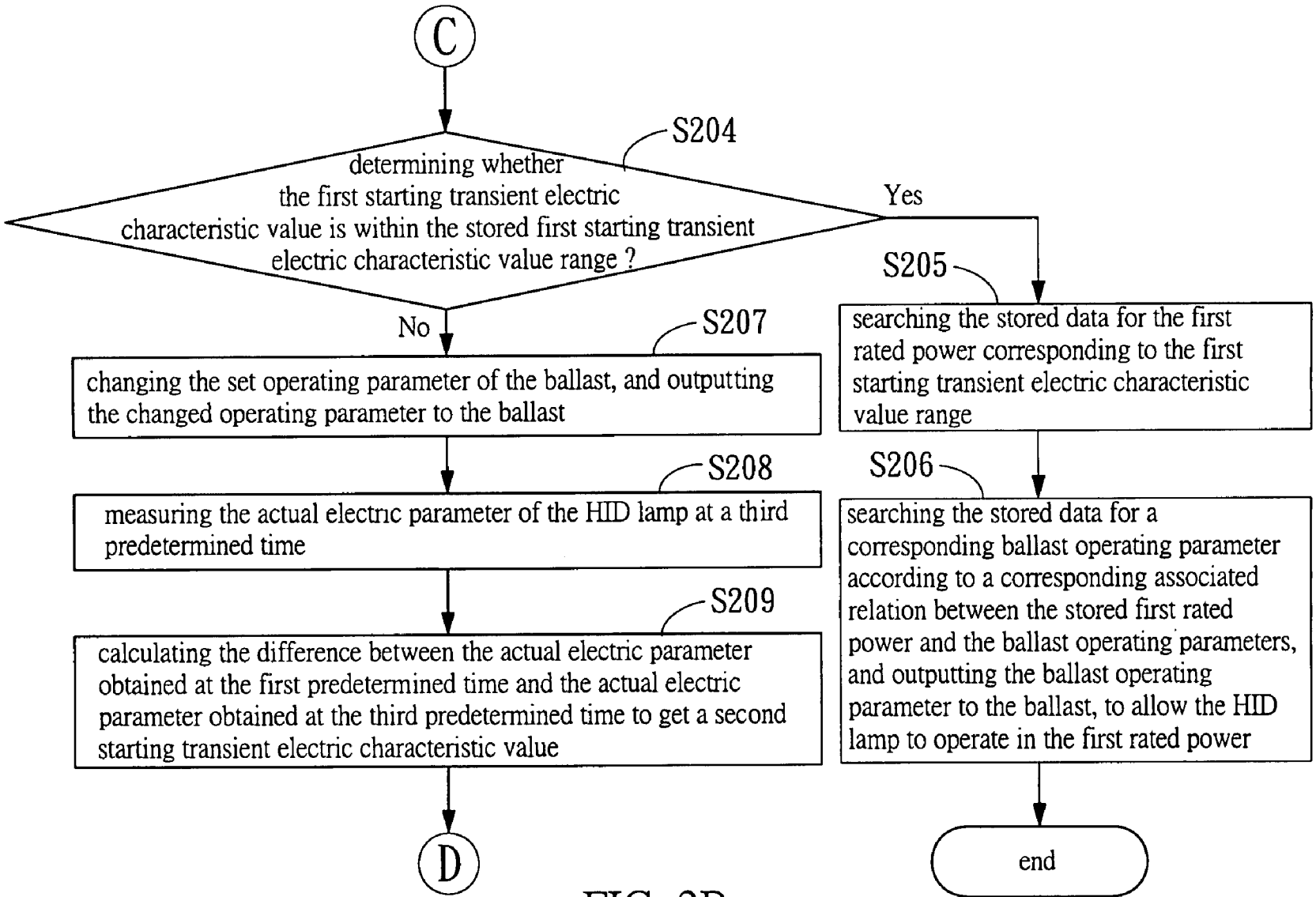
Figure 2C:
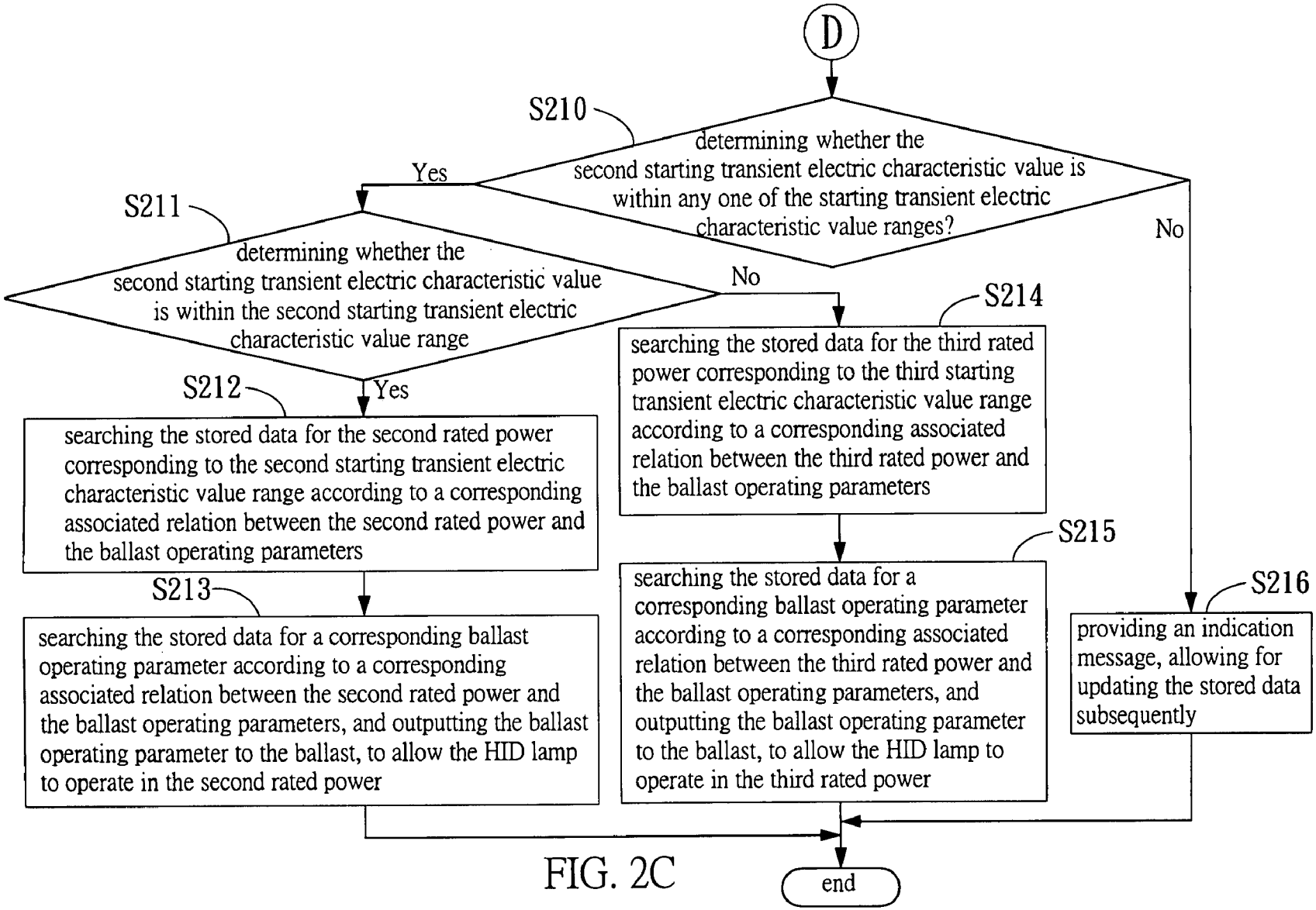

Please refer to FIGS. 2A, 2B and 2C, which are flow charts of a method of controlling a ballast for a HID lamp of another embodiment according to the present invention. In this embodiment, a first, second and third rated power are exemplified as the stored rated power. Note that the stored rated power are not limited to the first and second rated power in the previous embodiment or the first, second and third rated power in this embodiment. Of course, the more the number of the rated power is, the efficient the identifying function becomes. Further, any number of the rated power will be within the scope of the previous and this embodiments.

As shown in FIGS. 2A, 2B and 2C, the method starts in step S200, and discloses storing the first, second and third rated power, a plurality of starting transient electric characteristic value ranges of the HID lamp corresponding to the first, second and third rated power in a one-to-one manner, and a plurality of ballast operating parameters corresponding to the first, second and third rated power in a one-to-one manner. In this embodiment, the HID lamp has a first starting transient electric characteristic value equal to the difference between actual electric parameters obtained at a first predetermined time and at a second predetermined time during a transient process after the HID lamp is turned on, a second starting transient electric characteristic value equal to the difference between actual electric parameters obtained at the first predetermined time and at a third predetermined time during the transient process, and the actual electric parameters are a lamp voltage value, lamp current value, and/or lamp power value. In this embodiment, the first, second and third rated power are equal to 20, 35 and 70 watts, respectively, the actual electric parameters are the lamp current value, the first, second and third predetermined time are 5, 15 and 25 seconds, respectively, after the HID lamp is turned on, the first starting transient electric characteristic value range is greater than 1.5 amps and corresponds to the first starting transient electric characteristic value (i.e. the difference between the current parameters obtained at 5 and 15 seconds after the HID lamp is turned on), the second starting transient electric characteristic value range is greater than 1.5 amps and corresponds to the second starting transient electric characteristic value (i.e. the difference between the current parameters obtained at 5 and 35 seconds after the HID lamp is turned on), and the third starting transient electric characteristic value range is less than 1.5 amps and corresponds to the second starting transient electric characteristic value. Therefore, the HID lamp having the rated power of 20 watts has a starting transient electric characteristic value range corresponding to the first starting transient electric characteristic value range, the HID lamp having the rated power of 35 watts has a starting transient electric characteristic value range corresponding to the second starting transient electric characteristic value range, and the HID lamp having the rated power of 70 watts has a starting transient electric characteristic value range corresponding to the third starting transient electric characteristic value range. The method proceeds to step S201.

In step S201, the method discloses setting an initial operating parameter of the ballast to turn on the HID lamp. In this embodiment, the initial operating parameter is the duty-ratio of the ballast. In other embodiments, the initial operating parameter is the duty-time, frequency or phase of the ballast. In this embodiment, the initial operating parameter is set to cause the ballast to have an output power of 25 watts. The method proceeds to step S202.

In step S202, the method discloses measuring actual electric parameters of the HID lamp at the first predetermined time (i.e. 5 seconds) and at the second predetermined time (i.e. 15 seconds) during the transient process after the HID lamp is turned on. In this embodiment, the actual electric parameters are actual voltage parameters, actual current parameters, actual power parameters, or other electric parameters (e.g. lamp equivalent impedance) obtained from the calculation of the previous parameters, but are not limited thereto. In this embodiment, the actual electric parameters are the actual current parameters and are denoted by i(5) and i(15). The method proceeds to step S203.

In step S203, the method discloses calculating the difference between the actual current parameter (i(5)) obtained at the first predetermined time and the actual current parameter (i(15)) obtained at the second predetermined time to get a first starting transient electric characteristic value, denoted by $\Delta i_1 = i(5) - i(15)$. The method proceeds to step S204.

In step S204, the method discloses determining whether the first starting transient electric characteristic value ($\Delta i_1$) is within the stored first starting transient electric characteristic value range (greater than 1.5 amps). If the first starting transient electric characteristic value ($\Delta i_1$) is within the stored first starting transient electric characteristic value range, the method proceeds to step S205, or else, the method proceeds to step S207.

In step S205, the method discloses searching the stored data for the first rated power (20 watts) corresponding to the first starting transient electric characteristic value range, that is, the current rated power of the HID lamp being the first rated power. The method proceeds to step S206.

In step S206, the method discloses searching the stored data for a corresponding ballast operating parameter according to a corresponding associated relation between the stored first rated power (20 watts) and the ballast operating parameters, and outputting the ballast operating parameter to the ballast, to allow the HID lamp to operate in the first rated power (20 watts). The method ends.

In step S207, the method discloses changing the set operating parameter of the ballast to turn on the HID lamp, and outputting the changed operating parameter to the ballast, to allow the HID lamp to operate in the changed operating parameter. In this embodiment, the operating parameter is the duty-ratio of the ballast, and the output power of the ballast is changed to 35 watts. The method proceeds to step S208.

In step S208, the method discloses measuring the actual electric parameter of the HID lamp at the third predetermined time (35 seconds after the HID lamp is turned on), the actual electric parameter being denoted by i(35). The method proceeds to step S209.

In step S209, the method discloses calculating the difference between the actual electric parameter (i(5)) obtained at the first predetermined time and the actual electric parameter (i(35)) obtained at the third predetermined time to get a second starting transient electric characteristic value, which is denoted by $\Delta i_2 = i(5) - i(35)$. The method proceeds to step S210.

In step S210, the method discloses determining whether the second starting transient electric characteristic value ($\Delta i_2$) is within any one of the starting transient electric characteristic value ranges (i.e. the second starting transient electric characteristic value range or the third starting transient electric characteristic value range ). If the second starting transient electric characteristic value ($\Delta i_2$) is within one of the starting transient electric characteristic value ranges, the method proceeds to step S211, or else, the method proceeds to step S216.

In step S211, the method discloses determining whether the second starting transient electric characteristic value ($\Delta i_2$) is within the second starting transient electric characteristic value range (greater than 1.5 amps). If the second starting transient electric characteristic value ($\Delta i_2$) is within the second starting transient electric characteristic value range, the method proceeds to step S212, or else (indicating that the second starting transient electric characteristic value ($\Delta i_2$) is within the third starting transient electric characteristic value range), the method proceeds to step S214.

In step S212, the method discloses searching the stored data for the second rated power (35 watts) corresponding to the second starting transient electric characteristic value range. The method proceeds to step S213.

In step S213, the method discloses searching the stored data for a corresponding ballast operating parameter according to a corresponding associated relation between the second rated power (35 watts) and the ballast operating parameters, and outputting the ballast operating parameter to the ballast, to allow the HID lamp to operate in the second rated power (35 watts). The method ends.

In step S214, the method discloses searching the stored data for the third rated power (70 watts) corresponding to the third starting transient electric characteristic value range. The method proceeds to step S215.

In step S215, the method discloses searching the stored data for a corresponding ballast operating parameter according to a corresponding associated relation between the third rated power (70 watts) and the ballast operating parameters, and outputting the ballast operating parameter to the ballast, to allow the HID lamp to operate in the third rated power (70 watts). The method ends.

In step S216, the method discloses providing an indication message, such as sounds or indication light, to indicate that the current rated power of the HID lamp is not any one of the stored rated power, allowing for updating the stored data subsequently.

Note that the number of the predetermined time for measurement is selected according to the function intensity (i.e. the rated power range) of the HID lamp, and can be equal to one or more than one. In a system having simple function requirement (e.g. having only two rated power, as shown in FIG. 1), one predetermined time suffices for the requirement, while in a demanding system (e.g. having as many as three rated power, as shown in FIGS. 2A, 2B and 2C), two or more than two predetermined time have to be selected as the time when the actual electric parameters are measured and obtained.

Figure 3:
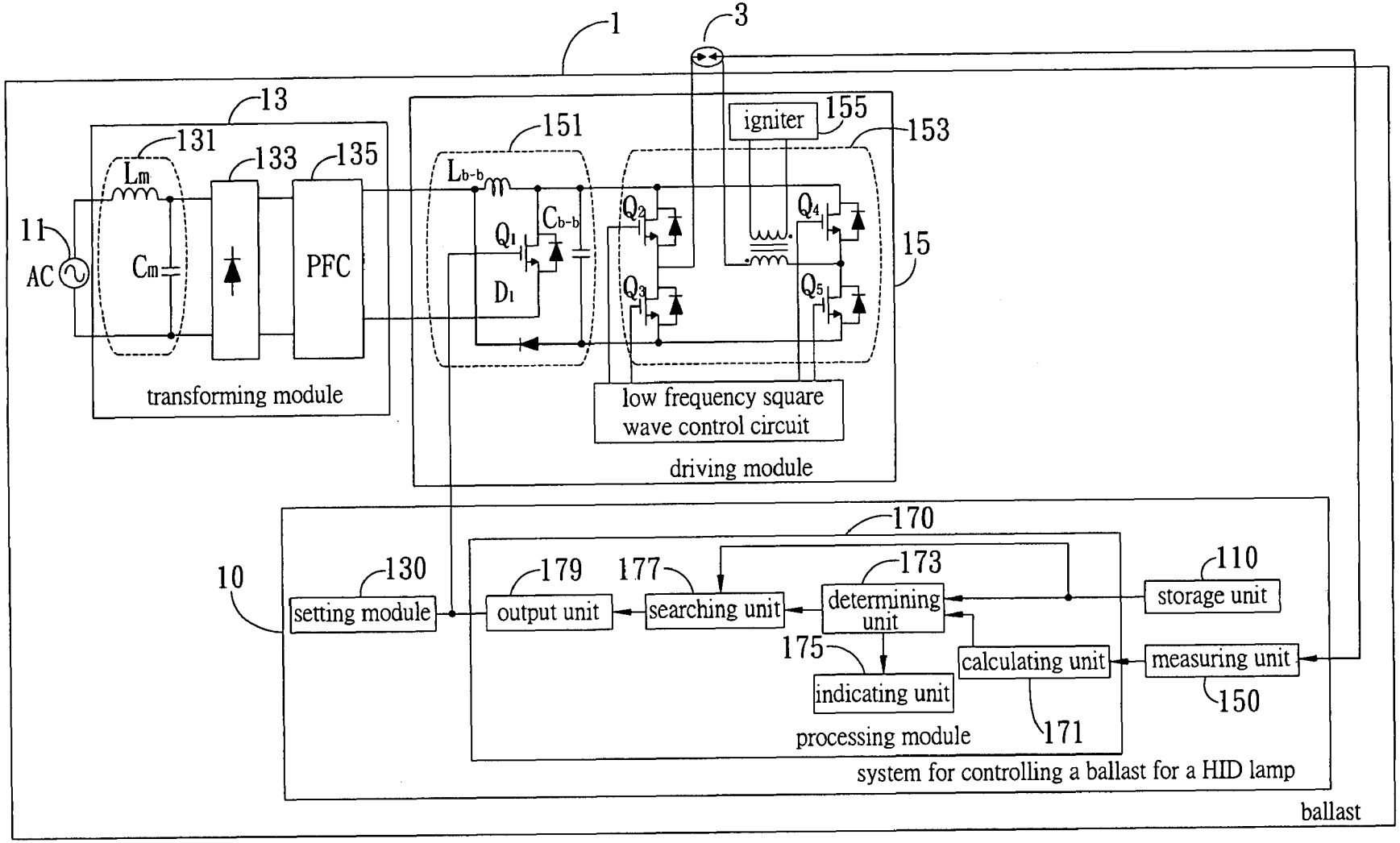
FIG. 3 is a functional block diagram of a ballast, a HID lamp, and a system for controlling the ballast for the HID lamp according to the present invention.

Please refer to FIG. 3, which is a functional block diagram of a ballast 1, a HID lamp 3, and a system 10 for controlling the ballast 1 for the HID lamp 3 according to the present invention. The system 10 can control two models of HID lamps having their own specific rated power to operate in their own specific rated power normally. In this embodiment, the ballast 1 comprises a power supplying module 11 for connecting with an external power source and providing power, a transforming module 13 electrically connected to the power supplying module 11, and a driving module 15 electrically connected to the transforming module 13 and the HID lamp 3. The transforming module 13 comprises a filtering unit 131 electrically connected to the power supplying module 11 for receiving and filtering the power provided by the power supplying module 11, a rectifying unit 133 electrically connected to the filtering unit 131 for receiving and rectifying the filtered power output from the filtering unit 131, and a modifying unit 135 electrically connected to the rectifying unit 133 for receiving the rectified power output from the rectifying unit 133 and modifying the power factor of rectified power to generate a modified power complying with a power mode supported by a power regulating unit 151 of the driving module 15. In this embodiment, the filtering unit 131 comprises an inductor and a capacitor, the rectifying unit 133 is a bridge rectifier, the modifying unit 135 is a power-factor corrector (PFC), and the power regulating unit 151 is a buck-boost converter.

The driving module 15 further comprises a driving unit 153 electrically connected to the power regulating unit 151 and the HID lamp 3, and an auxiliary driving unit 155 such as an igniter electrically connected to the driving unit 153 and the HID lamp 3. The power regulating unit 151 is used to receive an initial operating parameter set by a setting module 130 (described in the following paragraphs) and a ballast operating parameter output from a processing module 170 (described in the following paragraphs), and generate and output corresponding output power or currents to the driving unit 153. The driving unit 153 is used to receive the output power or currents generated by the power regulating unit 151, and generate a driving signal to drive the HID lamp 3 to operate in a corresponding rated power. In this embodiment, the driving unit 153 is a full-bridge inverter controlled by a low-frequency (200 Hz) square wave control circuit (as shown in FIG. 3). The auxiliary driving unit 155 is used to receive the driving signal generate by the driving unit 153, to facilitate the driving unit 153 to turn on the HID lamp 3 correspondingly. Note that although the ballast 1 in this embodiment is described by comprising the transforming module 13 and the driving module 15, the ballast of the present invention can be replaced by any electronic circuitry, as long as the electronic circuitry can realize the control of the HID lamp 3.

As shown in FIG. 3, the system 10 for controlling a ballast for a HID lamp according to the present invention is adapted to the power supplying module 11, the transforming module 13 and the driving module 15 of the ballast 1, and drive the HID lamp 3 to operate in its own specific rated power normally. The system 1 comprises a storage unit 110, a setting module 130, a measuring module 150, and a processing module 170.

The storage unit 110 is used to store a plurality of rated power, a plurality of starting transient electric characteristic value ranges of the HID lamp 3 corresponding to the rated power in a one-to-one manner, and a plurality of ballast operating parameters corresponding to the rated power in a one-to-one manner. In operation, the HID lamp 3, after being turned on, performs a transient process and a stable process sequentially. The starting transient electric characteristic values are obtained at one (or multiple) predetermined time during the transient process after the HID lamp 3 is turned on. The number of the predetermined time is selected according to the function intensity of the HID lamp 3, and can be equal to one or more than one. In a system having simple function requirement (e.g. having only two rated power, as shown in FIG. 1), one predetermined time suffices for the requirement. Accordingly, the starting transient electric characteristic value of the HID lamp 3 is the an electric parameter obtained at a predetermined time during the transient process after the HID lamp 3 is turned on. In a demanding system (e.g. having as many as three rated power), two or more than two predetermined time have to be selected as the time when the actual electric parameters are measured and obtained. Accordingly, the starting transient electric characteristic value of the HID lamp 3 is the operation values between the actual electric parameters obtained at two (or more than two) predetermined time during the transient process after the HID lamp 3 is turned on.

The starting transient electric characteristic value ranges are obtained by measuring electric parameters presented by the HID lamp 3 through experiments on measuring and comparing actual electric parameters. The electric parameters comprise voltage parameters, current parameters, and power parameters. Since a power parameter of the HID lamp is equal to a voltage parameter multiplied by a current parameter, and the variations in the power parameter can be reflected by the variations in the voltage and current parameter completely, only the voltage parameter and the current parameter are used to describe the present invention in the following embodiments. Further, the ballast operating parameters comprise a duty-ratio, duty-time, frequency and phase of the ballast, and those used to control the lamp current or lamp power output by the ballast. In the following embodiments, the ballast operating parameters are the duty-ratio of the ballast. In this embodiment, the ballast operating parameters are to control the duty-ratio of the power regulating unit 151, allowing the power regulating unit 151 to output corresponding power or currents to the driving unit 153 to control the HID lamp 3.

The setting module 130 is used to set an initial operating parameter of the ballast 1 to turn on the HID lamp 3, the initial operating parameter being output to the driving module 15 of the ballast 1 to turn on the HID lamp 3. The set initial operating parameter is a value appropriate enough to turn on the HID lamp 3. In this embodiment, the initial operating parameter controls the duty-ratio of the power regulating unit 151. In other embodiments, the initial operating parameter is the duty-time, frequency or phase of the ballast 1.

The measuring module 150 is used to measure an actual electric parameter of the HID lamp 3 at a predetermined time during a transient process after the HID lamp 3 is turned on. In this embodiment, the actual electric parameter is an actual voltage parameter, an actual current parameter or an actual power parameter, but is not limited thereto. The actual electric parameter can also be an electric parameter obtained from the calculation of the previous parameters, such as a lamp equivalent impedance. The number of the predetermined time depends on the rated power ranges actually used by the HID lamp 3.

The processing module 170 is used to receive the actual electric parameter measured by the measuring module 150 and generate a starting transient electric characteristic value of the HID lamp 3, determine whether the starting transient electric characteristic value is within the stored starting transient electric characteristic value ranges of the HID lamp 3 stored in the storage unit 110, search for a corresponding rated power according to a corresponding associated relation between the starting transient electric characteristic value ranges of the HID lamp 3 stored in the storage unit 110 if the starting transient electric characteristic value is within the stored starting transient electric characteristic value ranges of the HID lamp 3, and search the storage unit 110 for a correspond ballast operating parameter according to a corresponding associated relation between the rated power and the ballast operating parameters and output the corresponding ballast operating parameter to the driving module 15, to allow the HID lamp 3 to operate in the corresponding rated power. In one embodiment, the starting transient electric characteristic value of the HID lamp 3 is an actual electric parameter of the HID lamp 3 obtained at least one predetermined time during the transient process after the HID lamp 3 is turned on. In another embodiment, the starting transient electric characteristic value of the HID lamp 3 is an operation value between actual electric parameters obtained at least two predetermined time during the transient process after the HID lamp 3 is turned on.

In this embodiment, the processing module 170 comprises a calculating unit 171, a determining unit 173, an indicating unit 175, a searching unit 177 and an outputting unit 179. The calculating unit 171 is used to receive the actual electric parameters measured by the measuring module 150 and calculate the starting transient electric characteristic value of the HID lamp 3. The determining unit 173 is used to receive the starting transient electric characteristic value of the HID lamp 3 calculated by the calculating unit 171, determine whether the starting transient electric characteristic value of the HID lamp 3 is within any one of the starting transient electric characteristic value ranges stored in the storage unit 110, and send a searching signal if the starting transient electric characteristic value of the HID lamp 3 is within one of the starting transient electric characteristic value ranges, or else (that is, the starting transient electric characteristic value calculated by the calculating unit 171 is not within any one of the starting transient electric characteristic value ranges stored in the storage unit 110), send an indication signal. The indicating unit 175 is used to receive the indication signal sent from the determining unit 173 and provide an indication message such as sounds or indication light, to indicate that the current rated power of the HID lamp 3 is not any one of the stored rated power, to remind a user of updating the data stored in the storage unit 110. The searching unit 177 is used to receive the searching signal sent from the determining unit 173 and search the storage unit 110 for a rated power complying with the starting transient electric characteristic value ranges, and search the storage unit 110 for a corresponding ballast operating parameter according to a corresponding associated relation between the rated power and the ballast operating parameter. The outputting unit 179 is used to receive the ballast operating parameter searched by the searching unit 177 and output the ballast operating parameter to the driving module 15, to allow the HID lamp 3 to operate in the corresponding rated power. Therefore, the processing module 170 can identify the current rated power in which the HID lamp 3 operates accurately, and modify the operating parameter of the ballast 1 correctly, such that the HID lamp 3 can operate in the corresponding rated power normally.

In order to clearly understand how the system 10 of the present invention identifies the current rated power of the HID lamp 3 and modifies the operating parameter of the ballast 1, in order to allow the HID lamp 3 to operate in the corresponding rated power, the rated power of the HID lamp 3 are set to be 20, 35 and 70 watts, the measuring module 150 is used to measure the actual current parameter (i) of the HID lamp 3, and FIGS. 3 and 4 are illustrated to describe the identifying manner of the system 10 of the present invention.

Please refer to FIG. 4. It can be known through the experiment measurement that the starting transient electric characteristic value range of the HID lamp 3 corresponding to 20 watts is the difference between the actual current parameters obtained at a first predetermined time (5 seconds after the HID lamp 3 is turned on) and at a second predetermined time (15 seconds after the HID lamp 3 is turned on) and has a range greater than 1.5 amps, i.e. $\Delta i_1=(i(5)-i(15))>1.5$ A, that the starting transient electric characteristic value range of the HID lamp 3 corresponding to 35 watts is the difference between the actual current parameters obtained at the first predetermined time (5 seconds after the HID lamp 3 is turned on) and at another two predetermined time (including the second predetermined time (15 seconds after the HID lamp 3 is turned on) and a third predetermined time (35 seconds after the HID lamp 3 is turned on) and has one range less than 1.5 amps, i.e. $\Delta i_1=(i(5)-i(15))<1.5$ A and another range greater than 1.5 amps, i.e. $\Delta i_2=(i(5)-i(35))>1.5$ A, and that starting transient electric characteristic value range of the HID lamp 3 corresponding to 70 watts is the difference between the actual current parameters obtained at the first predetermine time (5 seconds after the HID lamp 3 is turned on) and at another two predetermined time (including the second predetermined time (15 seconds after the HID lamp 3 is turned on) and the third predetermined time (35 seconds after the HID lamp 3 is turned on) and has one range less than 1.5 amps, i.e. $\Delta i_1=(i(5)-i(15))<1.5$ A, and another range less than 1.5 amps, i.e. $\Delta i_2=(i(5)-i(35))<1.5$ A. At the same time, as shown in FIG. 4, the above three rated power (i.e. 20, 35 and 70 watts), the starting transient electric characteristic value ranges of the HID lamp 3 corresponding to the rated power, and the ballast operating parameters (i.e. the duty-ratio, including a %, b % and c %) corresponding to the rated power can be stored in the storage unit 110. Then, the setting module 130 sets the initial operating parameter of the ballast 1, and outputs the initial operating parameter to the driving module 15, to turn on the HID lamp 3. The measuring module 150 measures the actual current parameters at the first predetermined time (5 seconds after the HID lamp 3 is turned on) and at the second (15 seconds after the HID lamp 3 is turned on) and third predetermined time (35 seconds after the HID lamp 3 is turned), and denotes the measured actual current parameters as i(5), i(15) and i(35), respectively. The calculating unit 171 calculates the difference between the actual current parameters i(5), i(15) and i(35) obtained at the first, second and third predetermined time, respectively, to get two starting transient electric characteristic values, i.e. $\Delta i_1=i(5)-i(15)$ and $\Delta i_2=i(5)-i(35)$. The determining unit 173 determines whether the starting transient electric characteristic values calculated by the calculating unit 171 are within any one of the starting transient electric characteristic value ranges stored in the storage unit 110, and sends a searching signal if the starting transient electric characteristic values calculated by the calculating unit 171 are within at least one of the starting transient electric characteristic value ranges, or else, sends an indication signal, to allow the indicating unit 175 to provide an indication message such as sounds or indication light. The searching unit 177 receives the searching signal sent from the determining unit 173, and searches the storage unit 110 for a rated power complying with the starting transient electric characteristic value range. In practice, if the difference between the actual current parameters calculated by the calculating unit 171 is greater than 1.5 amps, the matched starting transient electric characteristic value range can be searched from the storage unit 110, and the corresponding rated power of 20 watts can be searched through the starting transient electric characteristic value range; if the starting transient electric characteristic value $\Delta i_1$ and $\Delta i_2$ (actual current parameters) calculated by the calculating unit 171 are less than and greater than 1.5 amps, respectively, the matched starting transient electric characteristic value range can be searched from the storage unit 110, and the corresponding rated power of 35 watts can be searched through the starting transient electric characteristic value range; if the starting transient electric characteristic values $\Delta i_1$ and $\Delta i_2$ calculated by the calculating unit 171 are both less than 1.5 amps, the matched starting transient electric characteristic value range can be searched from the storage unit 110, and the corresponding rated power of 70 watts can be further searched through the starting transient electric characteristic value range. Thus, the ballast operating parameter corresponding to the rated power can be further searched from the storage unit 110, and output by the outputting unit 179 to the driving module 15, to allow the HID lamp 3 to operate in the corresponding rated power.

Note that in the above embodiment the current parameter (i) is used as the measuring subject. However, in other embodiments, a voltage parameter can also be used as the measuring subject.

Please refer to FIG. 5 and FIG. 3. In the embodiment shown in FIG. 5, the HID lamp 3 has one of rated power of 20, 35 and 70 watts. The HID lamp 3 has the first starting transient electric characteristic value to be equal to the difference between the voltage parameters obtained at a first predetermined time (6 seconds after the HID lamp 3 is turned on) and at a second predetermined time (30 seconds after the HID lamp 3 is turned on) (i.e. $\Delta v_1=(v(30)-v(6))$), and the second starting transient electric characteristic value to be equal to the difference between the voltage parameters obtained at the first predetermined time (6 seconds after the HID lamp 3 is turned on) and a third predetermined time (40 seconds after the HID lamp 3 is turned on) (i.e. $\Delta v_2=(v(40)-v(6))$). It can be known through the experiment that the starting transient electric characteristic value range of the HID lamp 3 corresponding to 20 watts (i.e. a voltage parameter difference range in this embodiment) indicates that the first starting transient electric characteristic value of the HID lamp 3 exceeds 30 volts (i.e. $\Delta v_1>30V$), the starting transient electric characteristic value range of the HID lamp 3 corresponding to 35 watts indicates that the starting transient electric characteristic value of the HID lamp 3 is less than 30 volts (i.e. $\Delta v_1<30V$) and that the second starting transient electric characteristic value exceeds 15 volts (i.e. $\Delta v_2>15V$), the starting transient electric characteristic value range of the HID lamp 3 corresponding to 70 watts indicates that the first starting transient electric characteristic value of the HID lamp 3 is less than 30 volts (i.e. $\Delta v_1<30V$) and that the second starting transient electric characteristic value is less than 15 volts (i.e. $\Delta v_2<15V$). At the same time, as shown in FIG. 5, the above three rated power (i.e. 20, 35 and 70 watts), the starting transient electric characteristic value ranges of the HID lamp 3 corresponding to the rated power, and ballast operating parameters (i.e. the duty-ratio, a %, b % and c %) corresponding to the rated power can be stored in the storage unit 110. The setting module 130 sets the initial operating parameters of the ballast 1 and outputs the initial operating parameters to the driving module 15 to turn on the HID lamp 3. The measuring module 150 measures the actual voltage parameters at the first predetermined time (6 seconds after the HID lamp 3 is turned on), at the second predetermined time (30 seconds after the HID lamp 3 is turned on) and at the third predetermined time (40 seconds after the HID lamp 3 is turned on), and denotes the actual voltage parameters as v(6), v(30) and v(40). The calculating unit 171 calculates the difference between the actual voltage parameter v(6) obtained at the first predetermined time and the actual voltage parameters v(30) and v(40) obtained at the second and third predetermined time, to obtain two starting transient electric characteristic values, i.e. $\Delta v_1=v(30)-v(6)$ and $\Delta v_2=v(40)-v(6)$. The determining unit 173 determines whether the starting transient electric characteristic values calculated by the calculating unit 171 are within any one of the starting transient electric characteristic value ranges stored in the storage unit 110, and sends a searching signal if the starting transient electric characteristic values are within any one of the starting transient electric characteristic value ranges, or else, sends an indication signal, to allow the indicating unit 175 to provide an indication message such as sound or an indication light. The searching unit 177 receives the searching signal sent from the determining unit 173, and searches the storage unit 110 for a rated power complying with the starting transient electric characteristic value range. In practice, if the first starting transient electric characteristic value $\Delta v_1$ calculated by the calculating unit 171 is greater than 30 volts, the matched starting transient electric characteristic value range can be searched from the storage unit 110, and the corresponding rated power of 20 watts can be searched through the starting transient electric characteristic value range; if the first and second starting transient electric characteristic values $\Delta v_1$ and $\Delta v_2$ calculated by the calculating unit 171 are less than 30 watts and greater than 15 volts, respectively, the matched starting transient electric characteristic value range can be searched from the storage unit 110, and the corresponding rated power of 35 watts can be searched through the starting transient electric characteristic value range; if the first and second starting transient electric characteristic value $v_1$ and $v_2$ calculated by the calculating unit 171 are less than 30 volts and less than 15 volts, respectively, the matched starting transient electric characteristic value range can be searched from the storage unit 110, and the corresponding rated power of 70 watts can be searched through the starting transient electric characteristic value range. Therefore, the storage unit 110 can be further searched for the ballast operating parameters corresponding to the rated power, and the outputting unit 179 can be used to output the ballast operating parameters to the driving module 15 to control the HID lamp 3 to operate in the corresponding rated power.

Based on the principle that HID lamps having different rated power present different electric parameters during a transient process after being turned on, the method of controlling a ballast for a HID lamp and the related system employ a measuring module to measure actual electric parameters of the HID lamp during the transient process after the HID lamp is turned on, and calculate, process and analyze the actual electric parameters, to identify the current rated power of the HID lamp accurately and modify the operating parameters of the ballast correctly, such that the HID lamp can operate in the corresponding rated power.

In contrast to the prior art, the method of controlling a ballast for a HID lamp and related system of the present invention employ a storage unit to store a plurality of rated power of the HID lamps, a plurality of starting transient electric characteristic value ranges of the HID lamp corresponding to the rated power in a one-to-one manner, and a plurality of ballast operating parameters corresponding to the rated power in a one-to-one manner, a setting module to set the operating parameters of the ballast and output the operating parameters to a driving module of the ballast to turn on the HID lamp, and a measuring module to measure, during a transient process after the HID lamp is turned on, a plurality of actual electric parameters of the HID lamp at various predetermined time, for a processing module to generate a starting transient electric characteristic value of the HID lamp, search the storage unit for a rated power corresponding to the starting transient electric characteristic value range of the HID lamp after determining that the starting transient electric characteristic value is within any one of the starting transient electric characteristic value ranges stored in the storage unit, and search the storage unit for a corresponding ballast operating parameter according to a corresponding associated relation between the rated power and the ballast operating parameter and output the ballast operating parameter to the driving module, to allow the HID lamp to operate in the corresponding rated power. Therefore, the ballast can be adapted to and control a plurality of models of HID lamps having their various rated power to operate in their own specific rated power, such that the drawbacks of the prior art, such as that a HID lamp has to cooperate with a dedicated ballast, and that since there are a variety of models of HID lamps and these HID lamps have diverse rated power a variety of ballasts have to be brought to the market, which increases the cost for the manufacturer to manufacture the ballast, can be overcome. Further, there is no need for the method and system of the present invention to consider the rated power of the HID lamp, and the problem that the HID lamp selects an inappropriate ballast is solved.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A method of controlling a ballast for a high intensity discharge (HID) lamp, the method comprising the following steps of:

(a) outputting an initial operating parameter to the ballast to turn on the HID lamp;

(b) measuring an electric parameter at least at one predetermined time during a transient process after the HID lamp is turned on, and generating an HID starting transient electric characteristic value of the HID lamp based on the measured electric parameter;

(c) determining whether the HID starting transient electric characteristic value is within a starting transient electric characteristic value range; and (d) when the HID starting transient electric characteristic value is within the starting transient electric characteristic value range, searching a plurality of stored rated power data for a lamp rated power corresponding to the HID lamp according to a corresponding associated relation between the starting transient electric characteristic value range and one of the plurality of stored rated power data, and searching for a ballast operating parameter corresponding to the lamp rated power according to corresponding associated relations between each of the stored rated power data and one of a plurality of stored ballast operating parameters, and outputting the corresponding ballast operating parameter to the ballast, to allow the HID lamp to operate in the lamp rated power, wherein the initial operating parameter and the corresponding ballast operating parameter each control a current output from the ballast.

2. The method of claim 1, further comprising:

executed earlier than step (a), step (e) of storing the plurality of stored rated power data, the plurality of stored rated power data relating to at least two rated powers of the HID lamp, a plurality of starting transient electric characteristic value ranges corresponding to the at least two rated powers, and a plurality of ballast operating parameters corresponding to the at least two rated powers.

3. The method of claim 1, wherein the initial operating parameter and the corresponding ballast operating parameter each control a duty-ratio, duty-time, frequency or phase of the ballast.

4. The method of claim 1, wherein the HID starting transient electric characteristic value is an electric parameter of the HID lamp obtained at the at least one predetermined time during the transient process after the HID lamp is turned on.

5. The method of claim 4, wherein the electric parameter is at least one of an voltage parameter, current parameter and power parameter of the HID lamp.

6. The method of claim 1, the HID starting transient electric characteristic value is an operation value determined from values of the electric parameter measured at two predetermined times during the transient process.

7. The method of claim 6, wherein the electric parameter includes at least one of an voltage parameter, current parameter and power parameter of the HID lamp.

8. The method of claim 1, wherein step (c) comprises determining whether the HID starting transient electric characteristic value is within one of a plurality of stored starting transient electric characteristic value ranges.

9. The method of claim 1, further comprising:

(f) providing an indication message if the starting transient electric characteristic value of the HID lamp is determined not to be within the starting transient electric characteristic value range.

10. A system for controlling a ballast for a HID lamp, comprising:

a setting module for outputting an initial operating parameter to the ballast to turn on the HID lamp;

a measuring module for measuring an electric parameter at least at one predetermined time during a transient process after the HID lamp is turned on; and a processing module for receiving the measured electric parameter, generating an HID starting transient electric characteristic value of the HID lamp based on the measured electric parameter, determining whether the HID starting transient electric characteristic value is within a stored starting transient electric characteristic value range and when the HID starting transient electric characteristic value is within the stored starting transient electric characteristic value range searching a plurality of stored rated power data for a lamp rated power according to a corresponding associated relation between the stored starting transient electric characteristic value range and the stored rated power data, searching for a corresponding ballast operating parameter corresponding to the searched lamp rated power according to corresponding associated relations between each of the stored rated power data and one of a plurality of stored ballast operating parameters, and outputting the corresponding ballast operation parameter to the ballast, to allow the HID lamp to operate in the lamp rated power, wherein the initial operating parameter and the corresponding ballast operating parameter each control a current output from the ballast.

11. The system of claim 10, further comprising a storage unit for storing the plurality of stored rated power data, the plurality of stored rated power data corresponding to a plurality of rated powers, a plurality of starting transient electric characteristic value ranges that each correspond to one of the stored rated powers, and a plurality of ballast operating parameters that each correspond to one of the stored rated powers.

12. The system of claim 10, wherein the initial operating parameter and the corresponding ballast operating parameter each control a duty-ratio, duty-time, frequency and phase of the ballast.

13. The system of claim 10, wherein the HID starting transient electric characteristic value is an electric parameter obtained at a predetermined time during the transient process after the HID lamp is turned on.

14. The system of claim 10, wherein the HID starting transient electric characteristic value of the HID lamp is an operation value determined from values of the electric parameter measured at two predetermined times during the transient process after the HID lamp is turned on.

15. The system of claim 10, wherein the electric parameter includes at least one of an voltage parameter, current parameter and power parameter of the HID lamp.

16. The system of claim 10, wherein the ballast comprises a driving module electrically connected to the HID lamp for controlling the HID lamp to operate in the lamp rated power.

17. The system of claim 16, wherein the driving module comprises:

a power regulating unit for receiving the initial operating parameter output from the setting module or the corresponding ballast operating parameter output from the processing module, and generating a regulation signal according to the received operating parameter; and a driving unit electrically connected to the power regulating unit and the HID lamp for receiving the regulation signal to control the HID lamp to operate in the lamp rated power.

18. A system for controlling a ballast for a HID lamp, comprising:

a setting module for outputting an initial operating parameter to the ballast to turn on the HID lamp;

a measuring module for measuring an electric parameter at least at one predetermined time during a transient process after the HID lamp is turned on; and a processing module for receiving the measured electric parameter, generating an HID starting transient electric characteristic value of the HID lamp based on the measured electric parameter, determining whether the HID starting transient electric characteristic value is within a stored starting transient electric characteristic value range and when the HID starting transient electric characteristic value is within the stored starting transient electric characteristic value range searching a plurality of stored rated power data for a lamp rated power according to a corresponding associated relation between the stored starting transient electric characteristic value range and the stored rated power data, searching for a corresponding ballast operating parameter corresponding to the searched lamp rated power according to corresponding associated relations between each of the stored rated power data and one of a plurality of stored ballast operating parameters, outputting the corresponding ballast operation parameter to the ballast, to allow the HID lamp to operate in the lamp rated power, a storage unit storing the starting transient electric characteristic value range, the starting transient electric characteristic value range including a plurality of starting transient electric characteristic value ranges, the stored rated power data and the plurality of stored ballast operating parameters, a calculating unit for receiving the electric parameter measured by the measuring module and calculating the starting transient electric characteristic value of the HID lamp, a determining unit for receiving the starting transient electric characteristic value of the HID lamp calculated by the calculating unit, determining whether the HID starting transient electric characteristic value is within any one of the plurality of stored starting transient electric characteristic value ranges, and sending a searching signal if the HID starting transient electric characteristic value is within one of the plurality of stored starting transient electric characteristic value ranges, or else, sending an indication signal, an indicating unit for receiving the indication signal sent from the determining unit and providing an indication message, a searching unit for receiving the searching signal sent from the determining unit, searching the storage unit for the lamp rated power complying with the HID starting transient electric characteristic value ranges, and searching the storage unit for the corresponding ballast operating parameter according to the corresponding associated relations between each of the stored rated powers and one of the ballast operating parameters, and an outputting unit for receiving the corresponding ballast operating parameter searched by the searching unit and outputting the corresponding ballast operating parameter to the ballast, to allow the HID lamp to operate normally.

* * * * *